US010881577B2

(12) United States Patent
Hashimoto et al.

(10) Patent No.: US 10,881,577 B2
(45) Date of Patent: Jan. 5, 2021

(54) BEAUTY APPARATUS

(71) Applicant: Panasonic Intellectual Property Management Co., Ltd., Osaka (JP)

(72) Inventors: Natsumi Hashimoto, Shiga (JP); Tetsuro Hashiguchi, Shiga (JP); Seiko Yabuuchi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 299 days.

(21) Appl. No.: 15/866,946

(22) Filed: Jan. 10, 2018

(65) Prior Publication Data

US 2018/0193219 A1 Jul. 12, 2018

(30) Foreign Application Priority Data

Jan. 12, 2017 (JP) ..... 2017-003164

(51) Int. Cl.
*A61H 7/00* (2006.01)
*A47K 7/00* (2006.01)
(Continued)

(52) U.S. Cl.
CPC ..... *A61H 7/005* (2013.01); *A47K 5/1201* (2013.01); *A47K 5/16* (2013.01); *A47K 7/04* (2013.01);
(Continued)

(58) Field of Classification Search
CPC .... A61H 2015/0007; A61H 2015/0014; A61H 2015/0021; A61H 2015/0028; A61H 2015/0035; A61H 2015/0042; A61H 2015/005; A61H 2015/0057; A61H 2015/0071; A61H 15/0078; A61H 15/0092; A61H 15/02; A61H 7/002; A61H 7/003; A61H 7/004; A61H 7/007; A61H 7/008; A61H 2007/009; A61H 2201/0107; A61H 2201/0153; A61H 2201/0157; A61H 2201/1215; A61H 2201/1472;
(Continued)

(56) References Cited

U.S. PATENT DOCUMENTS 6,494,849 B2 * 12/2002 Kuo ..... A61H 15/0078 601/112
9,421,146 B2 * 8/2016 Muraki ..... A61H 7/005
(Continued)

FOREIGN PATENT DOCUMENTS

EP 1728494 A1 12/2006
JP 3-013138 U 2/1991
(Continued)

OTHER PUBLICATIONS

The Extended European Search Report dated May 25, 2018 for the related European Patent Application No. 18150260.0.

*Primary Examiner* — Bradley H Philips
*Assistant Examiner* — Savannah L Gabriel
(74) *Attorney, Agent, or Firm* — McDermott Will & Emery LLP

(57) ABSTRACT

A beauty apparatus includes a main body having a gripper and a head attached to one end of the main body. A circular opening from which foam is discharged is provided in the head, and spherical rollers are provided on at least one shaft extending in a circumferential direction of the opening.

14 Claims, 9 Drawing Sheets

(51) Int. Cl.

| | |
|---|---|
| ***A61H 15/00*** | (2006.01) |
| ***A61H 23/02*** | (2006.01) |
| ***A47K 5/16*** | (2006.01) |
| ***A47K 5/12*** | (2006.01) |
| ***B01F 13/00*** | (2006.01) |
| ***B01F 3/04*** | (2006.01) |
| ***B05B 15/25*** | (2018.01) |
| ***B01F 7/00*** | (2006.01) |
| ***A61H 35/00*** | (2006.01) |
| ***A47K 7/04*** | (2006.01) |
| *A45D 34/04* | (2006.01) |
| *A61H 33/04* | (2006.01) |
| *B05B 3/02* | (2006.01) |

(52) U.S. Cl.

CPC ..... *A61H 7/007* (2013.01); *A61H 15/0085* (2013.01); *A61H 23/0263* (2013.01); *A61H 35/008* (2013.01); *B01F 3/04453* (2013.01); *B01F 7/00891* (2013.01); *B01F 13/002* (2013.01); *B05B 15/25* (2018.02); *A45D 34/041* (2013.01); *A61H 2007/009* (2013.01); *A61H 2015/0014* (2013.01); *A61H 2015/0042* (2013.01); *A61H 2015/0057* (2013.01); *A61H 2023/0281* (2013.01); *A61H 2033/043* (2013.01); *A61H 2201/0207* (2013.01); *A61H 2201/105* (2013.01); *A61H 2201/1418* (2013.01); *A61H 2201/1463* (2013.01); *A61H 2201/1472* (2013.01); *A61H 2201/1664* (2013.01); *A61H 2201/1673* (2013.01); *A61H 2205/022* (2013.01); *B05B 3/02* (2013.01)

(58) Field of Classification Search

CPC .... A61H 15/00; A61H 15/0085; A61H 7/005; A61H 23/0263; A61H 35/008; A61H 2023/0281; A61H 2033/043; B05B 15/25; A47K 5/1201; A47K 5/16; A47K 7/04; B01F 3/04453; B01F 7/00891; B01F 13/002; A45D 34/041

See application file for complete search history.

(56) References Cited

U.S. PATENT DOCUMENTS

| | | | | |
|---|---|---|---|---|
| 2006/0276731 | A1 | 12/2006 | Thiebaut et al. | |
| 2007/0125113 | A1 | 6/2007 | Habatjou | |
| 2012/0310124 | A1* | 12/2012 | Zhang | A61H 15/0092 601/46 |
| 2014/0200507 | A1* | 7/2014 | Azeez | A61M 3/0258 604/28 |
| 2015/0305969 | A1* | 10/2015 | Giraud | A61H 15/0085 601/18 |
| 2016/0183743 | A1* | 6/2016 | Sueyoshi | A47K 5/16 15/21.1 |
| 2016/0235257 | A1* | 8/2016 | Daffer | A61H 9/0057 |
| 2016/0256348 | A1* | 9/2016 | Giraud | A61H 15/0085 |
| 2017/0128130 | A1* | 5/2017 | Giraud | A61N 5/0616 |
| 2018/0353747 | A1* | 12/2018 | Planard-Luong | A45D 34/00 |

FOREIGN PATENT DOCUMENTS

| | | | | |
|---|---|---|---|---|
| JP | 03013138 U | * | 2/1991 | A61H 15/00 |
| JP | 2003-325607 A | | 11/2003 | |
| JP | 2006-334411 A | | 12/2006 | |
| JP | 2007-152125 A | | 6/2007 | |
| JP | 2012-161517 A | | 8/2012 | |
| JP | 2012-217839 A | | 11/2012 | |
| WO | 1994/004116 A1 | | 3/1994 | |

* cited by examiner

BEAUTY APPARATUS

BACKGROUND

1. Technical Field

The present disclosure relates to a beauty apparatus.

2. Description of the Related Art

In recent years, a beauty apparatus such as a facial cleansing massager is known. For example, Japanese Patent Unexamined Publication No. 2003-325607 discloses a facial cleansing massager incorporating a pump and a motor inside a main body and sucking while rotating. In addition, Japanese Patent Unexamined Publication No. 2012-161517 discloses a device provided with a pair of spherical members (rollers) freely rotatable and supported to massage by lifting a skin of a cutis.

SUMMARY

A disclosure disclosed in Japanese Patent Unexamined Publication No. 2003-325607 and a disclosure disclosed in Japanese Patent Unexamined Publication No. 2012-161517 are combined to provide a suction massaging device. However, with such a massaging device, it is impossible to achieve both an appropriate facial cleansing effect and a massage effect. That is, in a case where facial cleansing is performed while sucking the skin, sebum can be removed by suction, but there is a problem that it is impossible to suck old dead skin cells. In addition, although it is possible to massage with a roller, in a case of being combined with suction, suction cannot be performed unless the roller is sealed to the skin surface. Therefore, it is difficult to press the roller against the skin, and there is a problem that the feeling of massage is suppressed.

The disclosure provides a beauty apparatus that can achieve both an appropriate facial cleansing effect and a massage effect.

The beauty apparatus according to an aspect of the disclosure is provided with a main body having a gripper and a head attached at one end of the main body. A circular opening for discharging foam is provided in the head, and spherical rollers are provided on at least one shaft extending in the circumferential direction of the opening.

With this configuration, the disclosure can provide a beauty apparatus capable of achieving both the appropriate facial cleansing effect and the massage effect.

DETAILED DESCRIPTION

Exemplary Embodiment

Figure 1:
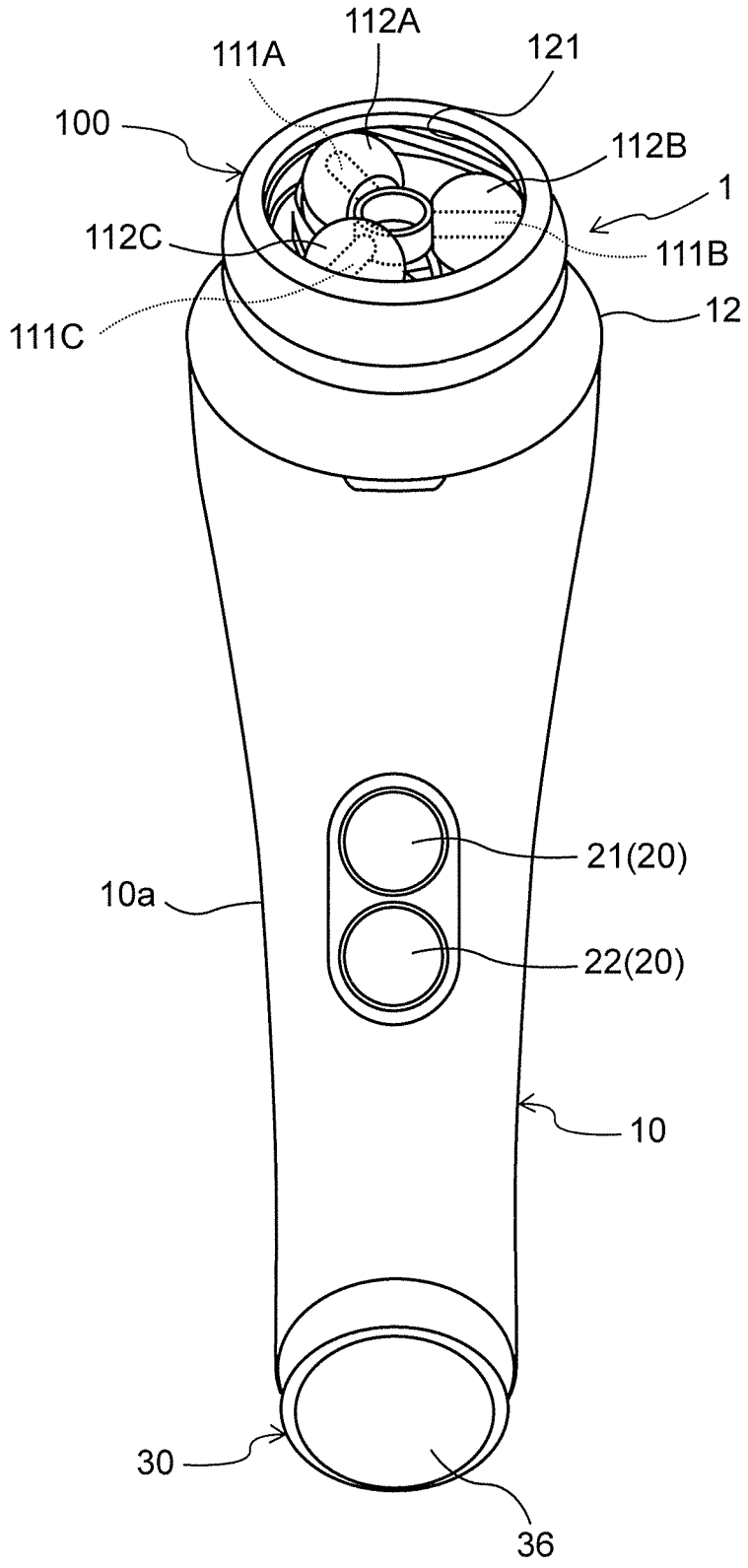
FIG. 1 is a front view illustrating a beauty apparatus according to an exemplary embodiment.
Figure 2:
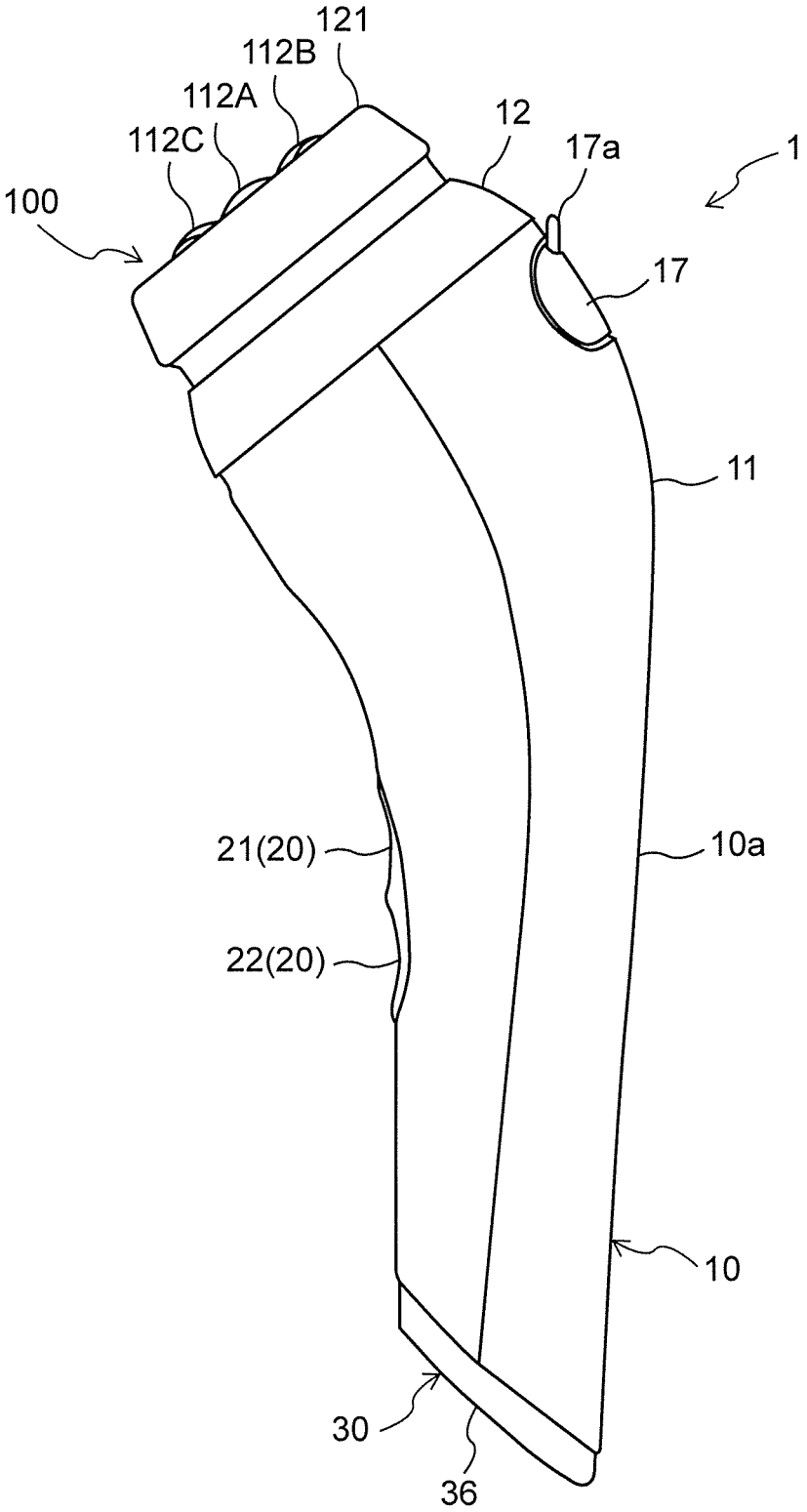
FIG. 2 is a side view illustrating the beauty apparatus according to the exemplary embodiment.

As illustrated in FIGS. 1 and 2, beauty apparatus 1 according to an exemplary embodiment is a beauty apparatus having a handy type mainly used for cleansing a face, and is provided with main body 10 formed with gripper 10*a*, and head 100 detachably attached to main body 10.

Head 100 massages a target part (for example, facial skin) as a part to be cleaned with a roller to which foam (cleansing agent) is supplied, thereby promoting removal of contamination of the target part and massaging the skin. As will be described later in detail, head 100 is provided with circular opening 121 for discharging the foam, and spherical rollers 112A, 112B, and 112C are provided on each of three shafts 111A, 111B, and 111C extending in the circumferential direction of opening 121. As a result, rollers 112A, 112B, and 112C rotating on the skin surface stir the foam and it is possible to wash a face while massaging, so that it is possible to achieve both an appropriate cleansing effect and a massage effect. When the appropriate facial cleansing effect and the massage effect are combined, improvement of a cosmetic effect can be expected by synergistic effect, which is significantly profitable.

Details of Main Body

Figure 3:
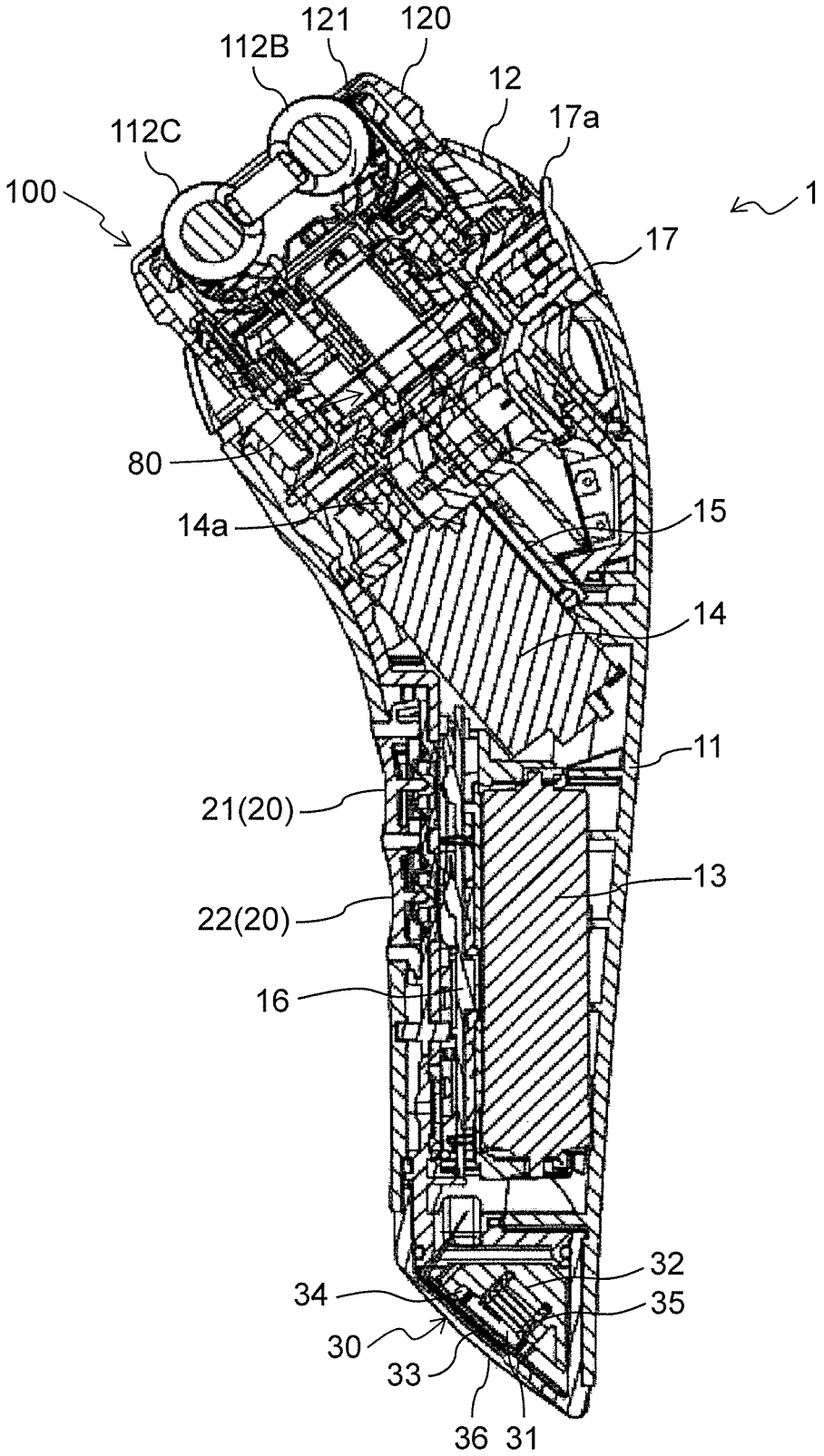
FIG. 3 is a cross-sectional view illustrating the beauty apparatus according to the exemplary embodiment.

Main body 10 is provided with housing 11 for accommodating various elements such as driving source 14 (refer to FIG. 3), cap 12 fitted to a top of housing 11, operation portion 20 operated to drive beauty apparatus 1, and thermal mechanism 30 for outputting heat. In the exemplary embodiment, thermal mechanism 30 is disposed at a bottom of housing 11. It is possible not to provide thermal mechanism 30.

Housing 11 has a waterproof structure, and gripper 10*a* is provided in a center of housing 11. In the exemplary embodiment, as illustrated in FIG. 2, in housing 11, the top (side on which head 100 is mounted) of housing 11 is curved with respect to a grip portion (gripper 10*a*) of housing 11. In this manner, by bending the top of housing 11 with respect to the grip portion, when a user grips the grip portion of housing 11, it is easy to apply head 100 to the skin.

In addition, inlet 18 (refer to FIG. 5) for injecting a foaming agent (cleaning agent) inside housing 11 is formed on a rear surface of housing 11. Examples of the foaming agent used in beauty apparatus 1 include a gel foaming agent and a liquid foaming agent.

Furthermore, main body 10 is provided with lid 17 for closing inlet 18, and lid 17 is rotatably attached to housing 11. Inlet 18 is opened by pulling knob 17*a* formed on lid 17 and rotating lid 17. Inlet 18 may be opened by detachably providing lid 17 in housing 11 and removing lid 17 from housing 11.

Operation portion 20 can be configured to include a button, for example. In the exemplary embodiment, operation portion 20 is provided with first operation portion 21 for switching driving source 14 on and off and second operation portion 22 for switching thermal mechanism 30 on and off. That is, when first operation portion 21 is operated, an ON signal serving as an operation signal for switching driving source 14 from OFF to ON, or an OFF signal serving as an operation signal for switching driving source 14 from ON to OFF is output from first operation portion 21. On the other hand, when second operation portion 22 is operated, an ON signal serving as an operation signal for switching thermal mechanism 30 from OFF to ON, or an OFF signal serving as an operation signal for switching thermal mechanism 30 from ON to OFF is output from second operation portion 22.

Figure 4:
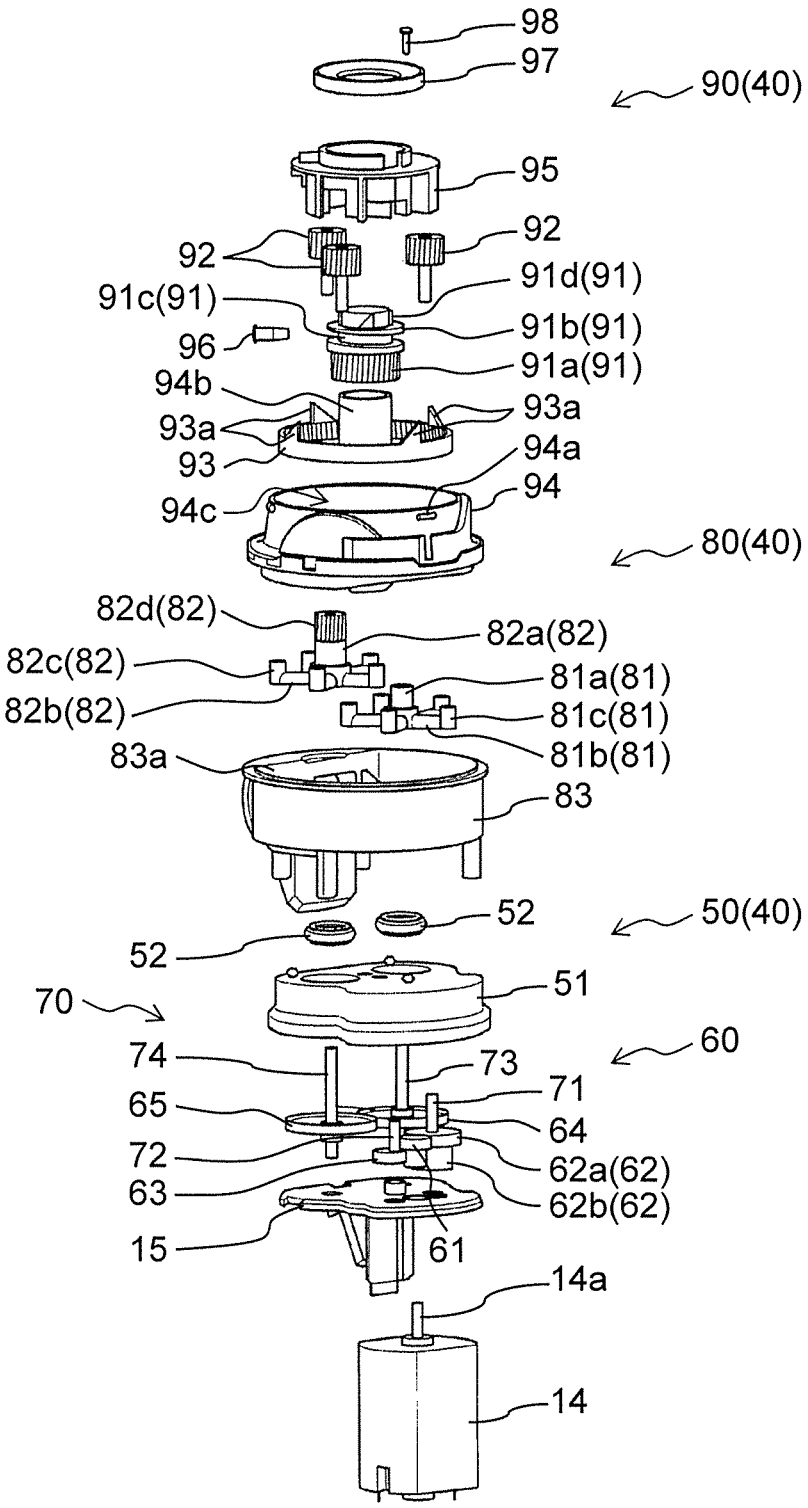
FIG. 4 is an exploded perspective view illustrating a driving source and a driving mechanism of the beauty apparatus according to the exemplary embodiment.

In addition, main body 10 is provided with power supplier 13 that supplies power of the primary battery or the secondary battery to each electric block, driving source 14 driven by the electric power supplied from power supplier 13, base 15 for holding driving source 14, and driving mechanism 40 configured to include a plurality of mechanical elements (refer to FIG. 4). These configuration elements (power supplier 13, driving source 14, base 15, and driving mechanism 40) are accommodated inside housing 11.

As driving source 14, for example, a motor can be used. In the exemplary embodiment, output shaft 14*a* of driving source 14 is connected to a part of driving mechanism 40.

Main body 10 is further provided with controller 16 that controls driving source 14 and thermal mechanism 30. Controller 16 controls driving source 14 and thermal mechanism 30 based on operation signals output from first operation portion 21 or second operation portion 22. In the exemplary embodiment, in a case where one of driving source 14 and thermal mechanism 30 is driven, controller 16 performs a prohibition control that does not drive the other of driving source 14 and thermal mechanism 30. For example, in a case where one of driving source 14 and thermal mechanism 30 is driven, the prohibition control can be performed by setting a flag for prohibiting the driving of the other of driving source 14 and thermal mechanism 30 to ON.

Thermal mechanism 30 is provided with thermal surface 36 formed in the bottom of housing 11, heater 31 driven by electric power supplied from power supplier 13, base 32 holding heater 31, and heater transfer plate 33 that transfers the heat of heater 31 to thermal surface 36. Furthermore, thermal mechanism 30 is provided with thermistor 34 for controlling the temperature of heater 31, and spring 35 for applying a force to heater 31 to press heater 31 against heat transfer plate 33.

Figure 5:
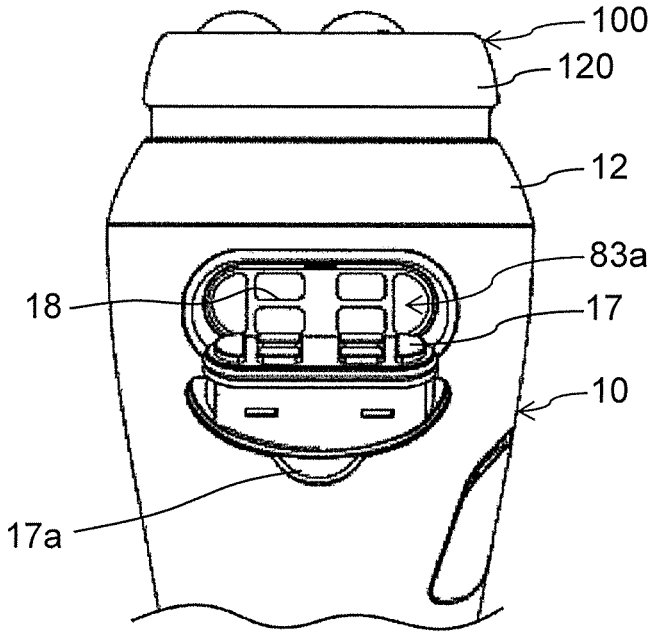
FIG. 5 is a view illustrating the beauty apparatus according to the exemplary embodiment, and is an enlarged rear view illustrating a state where a lid of the beauty apparatus is opened.

As illustrated in FIG. 4, driving mechanism 40 is provided with foam generating mechanism 80, first transmission block 50, and second transmission block 90. Foam generating mechanism 80 is a mechanism that generates the foam and supplies the foam to head 100 (refer to FIG. 1). Specifically, first rotor 81 and second rotor 82 which generate the foam by stirring a foaming agent, water, and air, and container 83 having space 83*a* capable of storing the foaming agent and water are provided. In the exemplary embodiment, first rotor 81 and second rotor 82 are disposed in space 83*a* of container 83 and are adapted to rotate in opposite directions to each other. Space 83*a* of container 83 communicates with inlet 18 of main body 10 as illustrated in FIG. 5.

First transmission block 50 transmits the driving force of driving source 14 to foam generating mechanism 80. Specifically, gear group 60 serving as a group of a plurality of gears, support shaft group 70 serving as a group of shafts supporting gear group 60, and gear case 51 accommodating gear group 60 are provided. In addition, two packings 52 that prevent the liquid and the like from flowing into gear case 51 are provided. In the exemplary embodiment, gear case 51 is coupled with base 15 holding driving source 14.

In addition, gear group 60 includes rotation driving gear 61, compound gear 62, rotation change gear 63, first rotation transmission gear 64, and second rotation transmission gear 65. Furthermore, compound gear 62 includes two gears having different diameters, that is, first compound gear 62*a* and second compound gear 62*b*.

In addition, support shaft group 70 includes first support shaft 71 coupled to compound gear 62, second support shaft 72 coupled to rotation change gear 63, third support shaft 73 coupled to first rotation transmission gear 64, and fourth support shaft 74 coupled to second rotation transmission gear 65.

One packing 52 is attached to the hole of gear case 51 through which third support shaft 73 passes, and the other packing 52 is attached to the hole of gear case 51 through which fourth support shaft 74 passes. In this manner, by attaching packing 52 to the hole of gear case 51, the liquid or the like can be prevented from flowing from container 83 to gear case 51.

Here, in the exemplary embodiment, output shaft 14*a* of driving source 14 supports rotation driving gear 61, and output shaft 14*a* and rotation driving gear 61 rotate integrally. In addition, rotation driving gear 61 is meshed with first compound gear 62*a*, and first compound gear 62*a* is meshed with first rotation transmission gear 64. Therefore, first rotation transmission gear 64 and third support shaft 73 rotate integrally. Third support shaft 73 supports first rotor 81, and third support shaft 73 and first rotor 81 rotate integrally.

Therefore, when output shaft 14*a* rotates, the rotation of output shaft 14*a* is transmitted in the order of rotation driving gear 61, first compound gear 62*a*, first rotation transmission gear 64, and first rotor 81. At this time, the rotation of output shaft 14*a* is transmitted to first rotor 81 while decelerating by gears 61, 62*a*, and 64.

In addition, first compound gear 62*a* and second compound gear 62*b* meshed with rotation driving gear 61 rotate integrally. Second compound gear 62*b* is meshed with rotation change gear 63 and rotation change gear 63 is meshed with second rotation transmission gear 65. Therefore, second rotation transmission gear 65 and fourth support shaft 74 rotate integrally. In addition, fourth support shaft 74 supports second rotor 82, and fourth support shaft 74 and second rotor 82 rotate integrally. The rotation direction of second rotor 82 is reversed from the rotation direction of first rotor 81 by rotation change gear 63.

Therefore, when output shaft 14*a* rotates, the rotation of output shaft 14*a* is transmitted in the order of rotation driving gear 61, first compound gear 62*a*, second compound gear 62*b*, rotation change gear 63, second rotation transmission gear 65, and second rotor 82. At this time, the rotation of output shaft 14*a* is transmitted to second rotor 82 while decelerating by gears 61, 62*a*, 62*b*, 63, and 65.

First rotor 81 is provided with base 81*a* coupled to third support shaft 73, a plurality of arms 81*b* extending substantially radially from base 81*a*, and column 81*c* protruding upward from tip ends of each arm 81*b*. In the exemplary embodiment, roots of the plurality of arms 81*b* are formed at equal intervals in the circumferential direction of base 81*a*. Arm 81*b* and column 81*c* contribute to promote stirring of the foaming agent and the like.

On the other hand, second rotor 82 is provided with base 82*a* coupled to fourth support shaft 74, a plurality of arms 82*b* extending substantially radially from the base 82*a*, column 82*c* protruding upward from the tip ends of each arm 82*b*, and rotation transmission gear 82*d* coupled to base 82*a*. In the exemplary embodiment, roots of the plurality of arms 82*b* are formed at equal intervals in the circumferential direction of base 82*a*. In addition, similar to arm 81*b* and column 81*c*, arm 82*b* and column 82*c* contribute to promote stirring of the foaming agent and the like.

In this manner, in the exemplary embodiment, first power transmission path for transmitting the rotation of output shaft 14*a* to first rotor 81, and second power transmission path for transmitting the rotation of output shaft 14*a* to second rotor 82 are formed by gear group 60.

Furthermore, in the exemplary embodiment, rotation transmission gear 82*d* meshes with a part of second transmission block 90.

Second transmission block 90 transmits the driving force of driving source 14 to head 100. Specifically, cam gear 91 serving as first transmission mechanism capable of transmitting torque to a roller portion 110 described later (refer to FIG. 9), and ring gear 93 serving as second transmission mechanism capable of transmitting torque to roller portion 110 of head portion 100 are provided.

Second transmission block 90 is further provided with a plurality of planetary gears 92 that mesh with ring gear 93, head mounter 94 to which head case 120 of head 100 is detachably attached, and bearing 94*b* that supports cam gear 91.

Head mounter 94 is provided with a plurality of projections 94*a* to be fitted in a recess (not illustrated) formed in head case 120 described later of head 100. Accommodation space 94*c* serving as a space for accommodating cam gear 91, planetary gear 92, and ring gear 93 is formed inside head mounter 94. Bearing 94*b* is fixed to head mounter 94 in a state of being disposed in accommodation space 94*c*. In addition, cam gear 91 is supported by bearing 94*b* in a state where cam gear 91 can rotate with respect to bearing 94*b*. Cam gear 91 and bearing 94*b* are hollow elements, and the space formed inside these elements communicates with space 83*a* of container 83.

Figure 7:
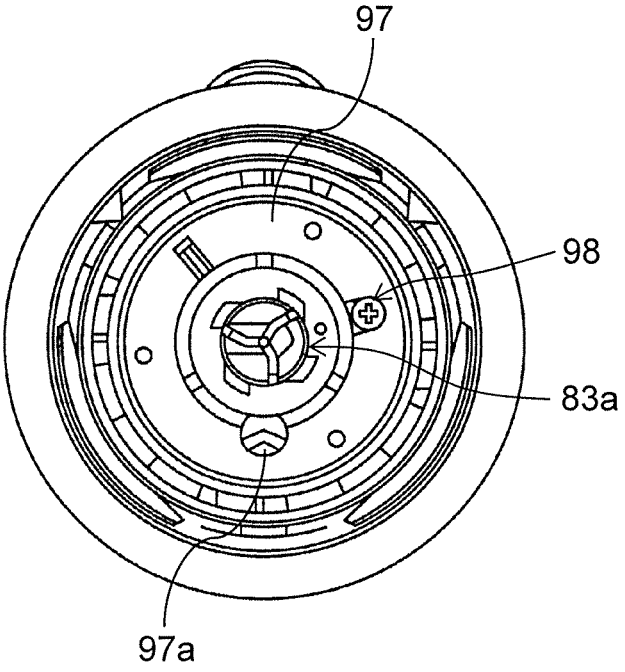
FIG. 7 is a plan view illustrating the driving mechanism of the beauty apparatus according to the exemplary embodiment.

Furthermore, second transmission block 90 is provided with gear cover 95 covering each gear, pin 96 inserted in a hole (not illustrated) of gear cover 95, and ring 97 disposed on the upper surface of gear cover 95. Gear cover 95 and ring 97 are fixed to head mounter 94 by screws 98. For example, ring 97 has a function of suppressing liquid or the like from flowing into gear cover 95 and a function of suppressing pin 96 from coming out in the radial direction of cam gear 91. In addition, as illustrated in FIG. 7, hole 97*a* penetrating gear cover 95 and communicating with space 83*a* is formed in ring 97.

Cam gear 91 is provided with gear 91*a* meshing with rotation transmission gear 82*d*, and cam 91*b* converting a rotation of gear 91*a* into a vertical movement with respect to head mounter 94. In addition, a plurality of hooks 91*d* capable of transmitting the rotation of gear 91*a* to roller portion 110 of head 100 via first roller base 116 (refer to FIGS. 8 and 10) is provided. Furthermore, helical groove 91*c* is formed on an outer periphery of cam 91*b*.

Figure 6:
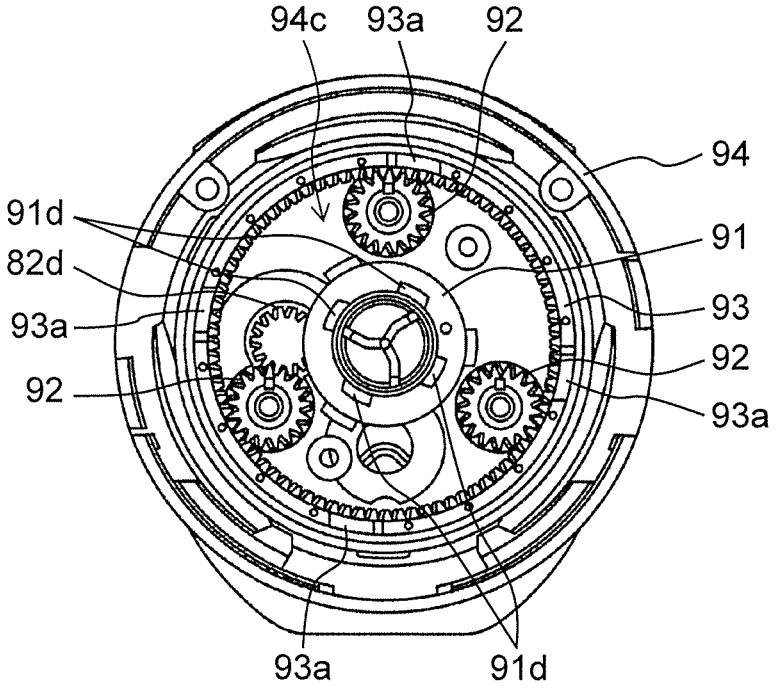
FIG. 6 is a plan view illustrating a part of the driving mechanism of the beauty apparatus according to the exemplary embodiment.

As illustrated in FIG. 6, rotation transmission gear 82*d* meshes with gear 91*a* of cam gear 91 and one planetary gear 92. In the exemplary embodiment, each planetary gear 92 is disposed at equal intervals around cam gear 91 and meshes with ring gear 93.

Ring gear 93 is disposed in accommodation space 94*c* of head mounter 94 and supported by head mounter 94 in a state where ring gear 93 can rotate with respect to head mounter 94. As illustrated in FIG. 4, a plurality of hooks 93*a* capable of transmitting the rotation of ring gear 93 to roller portion 110 of head 100 via first roller base 116 (refer to FIGS. 8 and 10) is formed in ring gear 93. In the exemplary embodiment, the rotation speed of ring gear 93 is adapted to be lower than the rotation speed of cam gear 91. Therefore, the speed of rotating roller portion 110 by ring gear 93 is slower than the speed of rotating roller portion 110 by cam gear 91.

Gear cover 95 closes the opening of head mounter 94 by being attached to head mounter 94. By attaching this gear cover 95 to head mounter 94, cam gear 91, planetary gear 92, and ring gear 93 are covered with gear cover 95.

In addition, pin 96 is inserted into a hole (not illustrated) formed in gear cover 95 from the outer peripheral side of gear cover 95, and the tip end of pin 96 is inserted into groove 91*c* of cam gear 91. In this manner, by inserting the tip end of pin 96 into groove 91*c* of cam gear 91, the tip end of pin 96 slides in groove 91*c* when cam gear 91 rotates. By sliding the tip end of pin 96 in groove 91*c*, a force for moving cam gear 91 in the axial direction is applied to cam gear 91, so that cam gear 91 reciprocates in the axial direction (vertical direction in FIG. 4) with respect to head mounter 94. In this manner, in the exemplary embodiment, cam gear 91 moves in a first axial direction serving as an axial direction toward head 100 and in a second axial direction serving as a direction opposite to the first axial direction.

When mounting head 100 on main body 10, torque is transmitted to roller portion 110 by cam gear 91 serving as the first transmission mechanism. In this manner, roller portion 110 moves in the direction of the rotation axis (vertical direction in FIG. 4) while rotating about rotation center C (refer to FIG. 8).

On the other hand, when mounting head 100 on main body 10, torque is transmitted to roller portion 110 by ring gear 93 serving as the second transmission mechanism. In this manner, roller portion 110 rotates about rotation center C.

Details of Head

Figure 8:
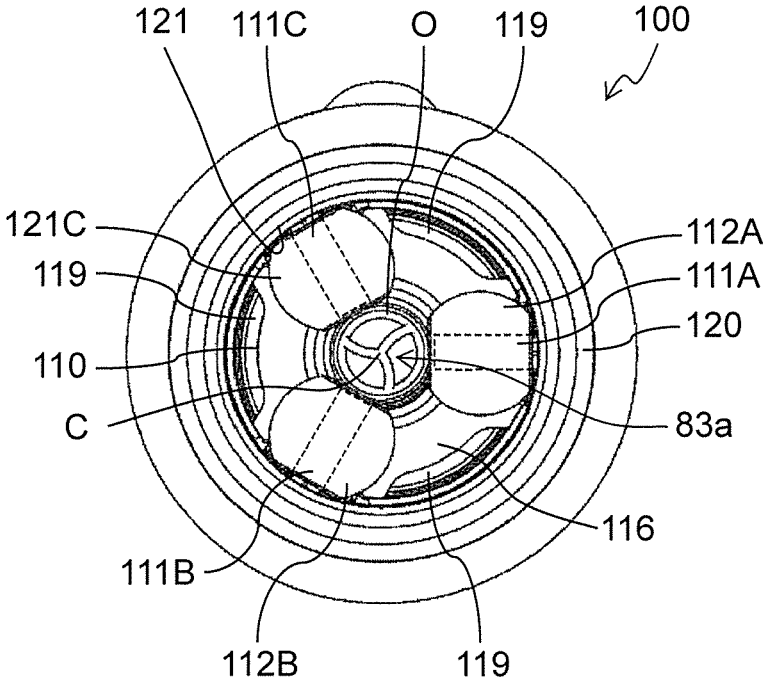
FIG. 8 is a view of a head of the beauty apparatus according to the exemplary embodiment viewed from a direction of a rotation axis.
Figure 9:
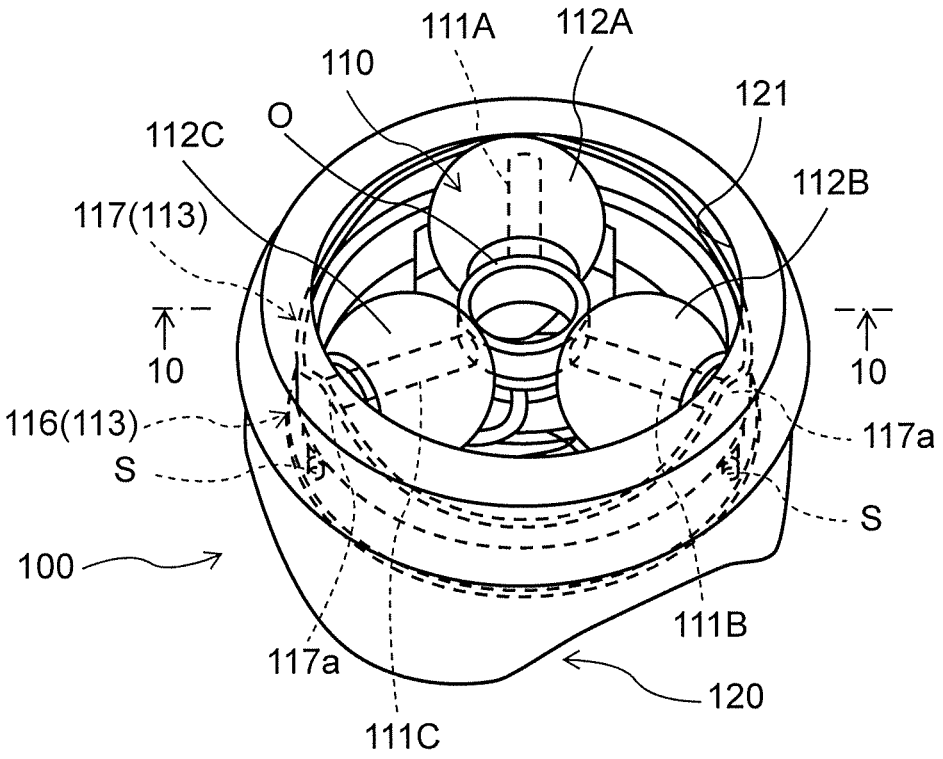
FIG. 9 is a perspective view illustrating the head of the beauty apparatus according to the exemplary embodiment.
Figure 10:
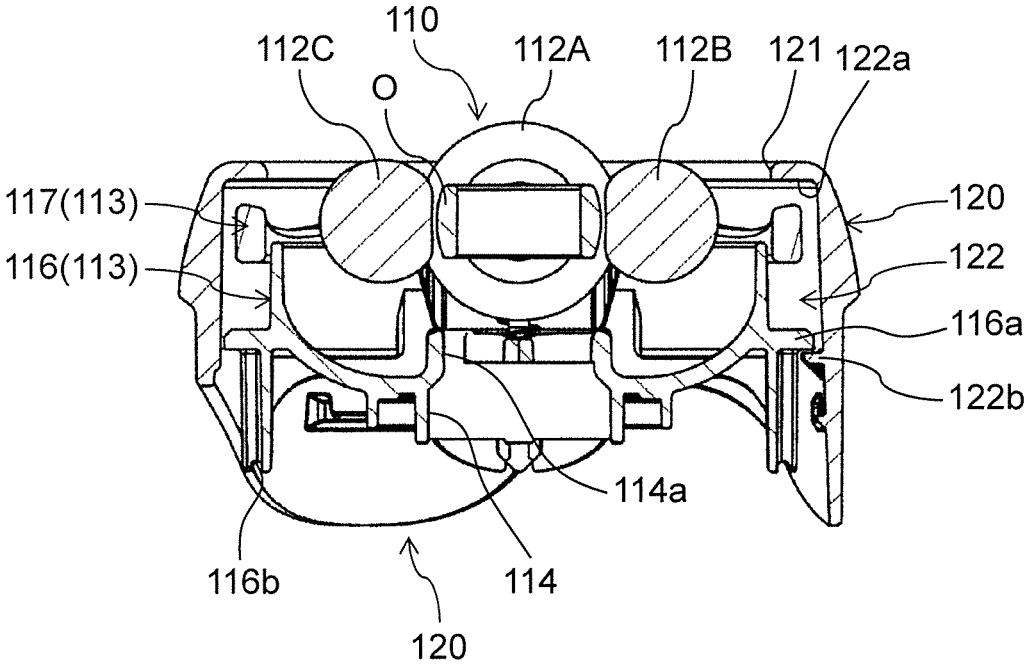
FIG. 10 is a cross-sectional view illustrating the head of the beauty apparatus according to the exemplary embodiment.

Next, the configuration of head 100 will be described in detail with reference to FIGS. 8 to 10. In FIGS. 8 to 10, head portion 100 configured to transmit the torque to roller portion 110 by ring gear 93 serving as the second transmission mechanism is illustrated as an example.

As illustrated in FIGS. 8 to 10, head 100 is provided with head case 120 and roller portion 110. Head case 120 is a cylindrical case disposed so as to surround the periphery of roller portion 110, and circular opening 121 through which the foam passes is formed. Roller portion 110 is supported by head case 120 in a state where roller portion 110 can rotate and move with respect to head case 120. This configuration will be described later.

Hereinafter, the configuration of roller portion 110 will be described in more detail. Roller portion 110 is a rotating structure holding spherical rollers 112A, 112B, and 112C, and is provided with first roller base 116 and second roller base 117 constituting basis 113.

First roller base 116 is a substantially circular base on which discharge hole 114 through which the foam passes is formed. Since discharge hole 114 is formed in the center portion of first roller base 116, the foam is easily evenly supplied to each portion on the surface side of first roller base 116 from discharge port 114*a* of discharge hole 114. The foam discharged from discharge port 114*a* of discharge hole 114 is received by the surface of first roller base 116 and the heavy foam containing water drops by centrifugal force from through-hole 119 formed in the outer periphery thereof.

The second roller base 117 is a substantially circular base provided on the front surface side of first roller base 116. Rollers 112A, 112B, and 112C are inserted through shafts 111A, 111B, and 111C extending outward from central ring O, and the tip ends of shafts 111A, 111B, and 111C are fixed to ridge 117*a* on the outer periphery of second roller base 117. When roller portion 110 is mounted on the inside of head case 120, the tip end of ridge 117*a* comes into contact with first regulator 122*a* (refer to FIG. 10) on the side of head case 120.

Between first roller base 116 and second roller base 117, as illustrated by a broken line in FIG. 9, spring S serving as an elastic member is disposed substantially at right angles to the rotation direction. Spring S is disposed below each tip end of shafts 111A, 111B, and 111C of rollers 112A, 112B, and 112C. As a result, when roller 112A is applied to the skin, roller 112A is pushed into head case 120. Similarly, when roller 112B is applied to the skin, roller 112B is pushed into head case 120, and when roller 112C is applied to the skin, roller 112C is pushed into head case 120. As a result, since excessive pressing of rollers 112A, 112B, and 112C against the skin is prevented by spring S, there is an effect that the skin is less likely to be damaged. The elastic member is not limited to spring S as long as appropriate elasticity and appropriate pushing distance can be obtained.

Here, as illustrated in FIG. 10, rollers 112A, 112B, and 112C protrude outward from a tip end surface of head case 120. The amount of protrusion of head case 120 from the tip end surface (hereinafter simply referred to as "protrusion amount") depends on the size and the like of rollers 112A, 112B, and 112C, and is preferably approximately 3 mm. As a result of testing various protrusion amounts, in a case where the protrusion amount was set to approximately 3 mm, it was possible to appropriately obtain both the feeling of washing with the foam and the feeling of massage. On the other hand, in a case where the protrusion amount was set to approximately 4 mm, the feeling of washing with the foam was impaired, and in a case where the protrusion amount was set to approximately 2 mm, the feeling of massage was impaired.

As a matter of course, the protrusion amount may be appropriately changed according to the sizes of rollers 112A, 112B, and 112C, and is not limited to approximately 3 mm. However, even in a state where rollers 112A, 112B, and 112C protrude mostly from head case 120, shafts 111A, 111B, and 111C are preferably accommodated in head case 120. In such a state, approximately half of rollers 112A, 112B, and 112C can protrude, so that it is possible to appropriately obtain both the feeling of washing with the foam and the feeling of massage.

Here, a configuration provided with three rollers 112A, 112B, and 112C is illustrated as an example, but the number of rollers is not limited thereto. As a matter of course, the number of shafts 111A, 111B, and 111C and the number of springs S may be changed according to the number of the rollers.

In addition, here, spherical rollers 112A, 112B, and 112C are illustrated as an example, but the shapes and sizes of rollers 112A, 112B, and 112C can be appropriately changed. For example, rollers 112A, 112B, and 112C may be formed in a long ellipsoid in the direction of shafts 111A, 111B, and 111C.

In addition, rollers 112A, 112B, and 112C may be disposed between opening 121 and head case 120. That is, the disposition of rollers 112A, 112B, and 112C can be appropriately changed according to the shape, size, number, and the like of rollers 112A, 112B, and 112C.

Next, a support structure of head 100 will be described in detail.

As illustrated in FIG. 10, groove 122 is formed on the inner peripheral surface of head case 120. By accommodating fitting portion 116*a* of roller portion 110 in groove 122, roller portion 110 is supported by head case 120 in a state where it is possible to perform operations of rotation with respect to head case 120 and of reciprocating movement in the direction of the rotation axis.

In addition, on the inner peripheral surface of head case 120, a plurality of recesses (not illustrated) to be fitted to the plurality of projections 94*a* of head mounter 94 are formed. By fitting this recess (not illustrated) to projection 94*a*, head case 120 is mounted on head mounter 94.

Head mounter 94 is non-rotatably fixed to housing 11, and head case 120 is non-rotatably mounted on head mounter 94. Therefore, when head 100 is mounted on main body 10, head case 120 is non-rotatably mounted on main body 10.

In addition, in groove 122, first regulator 122*a* for regulating roller portion 110 from excessively protruding from head case 120, and a plurality of second regulators 122*b* for regulating roller portion 110 from coming off head case 120 are formed. In the exemplary embodiment, the plurality of second regulators 122*b* are formed at positions facing first regulator 122*a*. For example, the plurality of second regulators 122*b* can be disposed at equal intervals on the inner peripheral surface of head case 120.

In this manner, first regulator 122*a* and second regulator 122*b* are formed in groove 122, so that roller portion 110 can be supported by head case 120 so as to reciprocate in the direction of the rotation axis within a predetermined range.

As described above, on the outer periphery of first roller base 116, fitting portion 116*a* to be fitted into groove 122 is formed. In addition, in first roller base 116, a plurality of hooks 116*b* are formed in contact with the plurality of hooks 93*a* of ring gear 93.

When head 100 having such a configuration is mounted on main body 10, a recessed (not illustrated) formed in the inner peripheral surface of head case 120 is fitted to projection 94*a* of head mounter 94, and head case 120 is non-rotatably mounted on head mounter 94. Hook 116*b* formed on first roller base 116 comes into contact with hook 93*a* formed on ring gear 93 and the torque is transmitted to roller portion 110 by ring gear 93.

At this time, discharge hole (hole) 114 formed in roller portion 110 communicates with space 83*a* of container 83 via the space inside bearing 94*b* of cam gear 91 and head mounter 94.

Therefore, when driving source 14 is driven in a state where head 100 is mounted on main body 10, roller portion 110 rotates relative to head case 120 (main body 10), and the foam generated by foam generating mechanism 80 is discharged from discharge hole 114. In this manner, in the exemplary embodiment, discharge hole (hole) 114 through which the foam can pass is formed at roller portion 110. As described above, since inlet 18 communicates with space 83*a*, when head 100 is mounted on main body 10, inlet 18 and discharge hole 114 communicate with each other.

How to Use

By using beauty apparatus 1 having such a configuration, for example, it is possible to remove dirt on the skin and to massage the skin by the following method.

First, head 100 is mounted on main body 10. Next, lid 17 is opened and a predetermined amount of the foaming agent is injected into space 83*a* from inlet 18. In addition, a predetermined amount of water is injected into space 83*a* from at least one of inlet 18 and discharge hole 114.

In a state where lid 17 is closed, rollers 112A, 112B, and 112C are applied to the skin surface.

In this state, first operation portion 21 is operated to switch driving source 14 from OFF to ON.

Thereafter, as driving source 14 is driven, the driving force is transmitted to foam generating mechanism 80 and roller portion 110. The foam is generated by driving foam generating mechanism 80, and the generated foam passes through discharge hole 114 and is supplied to the front side of basis 113. As a result, a state is formed where the foam exists between rollers 112A, 112B, and 112C, and the skin.

On the other hand, as roller portion 110 is driven, roller portion 110 rotates relative to head case 120 (main body 10). At this time, the heavy foam containing water drops from through-hole 119 by centrifugal force, the dense foam is retained in head case 120, and the dense foam adheres to rollers 112A, 112B, and 112C. Furthermore, rollers 112A, 112B, and 112C further stir the dense foam on the skin surface while massaging the skin. As a result, it is possible to remove excess sebum and old dead skin cell by the appropriate facial cleansing effect and obtain effects such as stimulation of blood circulation by the appropriate massage effect.

In addition, in a case where it is desired to throughly remove makeup or the like applied to the skin, for example, the following method can be used.

First, head 100 is mounted on main body 10. Next, second operation portion 22 is operated to switch thermal mechanism 30 from OFF to ON. Thermal surface 36 warmed by heater 31 is applied to the skin to warm the skin. In this manner, by warming the skin in advance, it is possible to more easily remove the makeup applied to the skin. Next, lid 17 is opened and a predetermined amount of the foaming agent is injected into space 83*a* from inlet 18. In addition, a predetermined amount of water is injected into space 83*a* from at least one of inlet 18 and discharge hole 114.

After warming the skin with thermal mechanism 30 for a certain period of time, second operation portion 22 is operated to switch thermal mechanism 30 from ON to OFF.

In a state where rollers 112A, 112B, and 112C are in contact with the skin surface, first operation portion 21 is operated to switch driving source 14 from OFF to ON and to drive foam generating mechanism 80 and roller portion 110.

While supplying the generated foam to the front surface side of basis 113 having first roller base 116 and second roller base 117, rollers 112A, 112B, and 112C are rotated to remove the dirt on the skin.

In order to move roller portion 110 in the direction of the rotation axis (vertical direction in FIG. 4) while rotating roller portion 110 about rotation center C in a state where head 100 is mounted on main body 10, the torque may be transmitted to roller portion 110 by cam gear 91 serving as the first transmission mechanism.

That is, when head 100 is mounted on main body 10, a hook in contact with hook 91*d* formed on cam gear 91 may be formed on roller portion 110 instead of hook 116*b*.

In this manner, as cam gear 91 rotates, roller portion 110 rotates. In addition, as cam gear 91 moves in the first axial direction, roller portion 110 is pushed and moved in the first axial direction which is a direction away from main body 10.

On the other hand, in a case where cam gear 91 moves in the second axial direction, roller portion 110 moves in the second axial direction which is a direction approaching main body 10 due to the action of gravity acting on roller portion 110.

In this manner, when head 100 is mounted on main body 10, the torque is transmitted to roller portion 110 via first roller base 116 by cam gear 91. As a result, roller portion 110 can be rotated relative to head case 120 (main body 10). At the same time, first roller base 116 can be relatively moved (reciprocating motion: vibration) in the axial direction with respect to head case 120 (main body 10), and the foam can be supplied to the skin surface while vibrating the skin surface. In this case, the dirt on the skin can be removed and the skin is massaged by the rotation of roller portion 110 and the vibration of first roller base 116.

As described above, beauty apparatus 1 according to the exemplary embodiment is provided with main body 10 having gripper 10*a* and head 100 attached to one end of main body 10. Circular opening 121 for discharging the foam is provided in head 100, and spherical rollers 112A, 112B, and 112C are provided in at least one or more shafts 111A, 111B, and 111C extending in the circumferential direction of opening 121. As a result, rollers 112A, 112B, and 112C rotating on the skin surface stir the foam and it is possible to wash the face while massaging, so that it is possible to achieve both an appropriate cleansing effect and a massage effect.

In addition, driving source 14 may be incorporated in main body 10 and rollers 112A, 112B, and 112C may be rotated about opening 121 by the rotational driving of driving source 14. As a result, since the foam can be stirred on the skin surface, it is possible to further provide beauty apparatus 1 safe against the skin.

In addition, rollers 112A, 112B, and 112C may be spring-biased substantially at right angles to the rotation direction. As a result, since rollers 112A, 112B, and 112C can be applied along the shape of the skin, it is possible to improve skin contact.

In addition, rollers 112A, 112B, and 112C may rotate freely to shafts 111A, 111B, and 111C. As a result, since rollers 112A, 112B, and 112C can be rotated along the shape of the skin, it is possible to further improve skin contact.

In addition, head 100 may have a structure in which roller portion 110 holding rollers 112A, 112B, and 112C is accommodated in cylindrical head case 120 in which opening 121 is formed. As a result, since the foam is retained inside head case 120, it is easy to bring the foam close to the skin.

In addition, a part of rollers 112A, 112B, and 112C protrudes from head case 120 in a side view, and when the skin is pressed against the protruding portion, all of rollers 112A, 112B, and 112C may be accommodated in head case 120. As a result, since rollers 112A, 112B, and 112C can be applied to the skin while the foam is brought close to the skin, it is possible to further enhance the facial cleansing effect.

In addition, even in a state where rollers 112A, 112B, and 112C protrude mostly from head case 120, shafts 111A, 111B, and 111C may be accommodated in head case 120. As a result, approximately half of rollers 112A, 112B, and 112C can protrude, and it is possible to appropriately obtain both the feeling of washing with the foam and the feeling of massage.

In addition, through-hole 119 may be formed on the outer edge of the bottom surface of roller portion 110. As a result, since the heavy foam containing water can be dropped from through-hole 119 by centrifugal force, it is possible to hold the dense foam in head case 120.

In addition, opening 121 may be disposed at a position facing the skin at the time of use. As a result, since opening 121 can be easily applied to the skin, it is possible to provide beauty apparatus 1 that is easy to use.

In the exemplary embodiment, both foam generating mechanism 80 and roller portion 110 are driven by driving source 14. Therefore, it is possible to reduce the size of beauty apparatus 1 and to reduce the manufacturing cost of beauty apparatus 1, as compared with a case where the driving sources for driving foam generating mechanism 80 and roller portion 110 exist individually.

In addition, in the exemplary embodiment, thermal mechanism 30 is adapted not to be driven in a case where driving source 14 is driven. In this manner, in a case where foam generating mechanism 80 and roller portion 110 are used for cleansing the skin and thermal mechanism 30 is not used, it is possible to prevent electric power from being supplied to thermal mechanism 30, and to achieve power saving.

In addition, in the exemplary embodiment, driving source 14 is adapted not to be driven in a case where thermal mechanism 30 is driven. In this manner, in a case where thermal mechanism 30 is used to warm the skin and foam generating mechanism 80 and roller portion 110 are not used, it is possible to prevent electric power from being supplied to driving source 14, and to achieve power saving. In addition, it is possible to prevent the foam from being discharged from roller portion 110 not directed to the skin.

Hereinbefore, although the preferred exemplary embodiment is described, the disclosure is not limited to the above exemplary embodiment, and various modifications are possible.

For example, the control by controller 16 is not limited to a control illustrated in the above exemplary embodiment, and various controls can be performed by controller 16.

In addition, it is possible to mount driving source 14 on head 100.

In addition, in the above exemplary embodiment, the driving force of driving source 14 is transmitted to foam generating mechanism 80 via first transmission block 50 and further transmitted to second transmission block 90. That is, by mounting head 100 on main body 10, both foam generating mechanism 80 and head 100 are driven by the driving force of driving source 14. However, it is possible to separately provide a driving source for driving foam generating mechanism 80 and a driving source for driving roller portion 110. At this time, each driving source can be mounted on the inside of main body 10, or at least one of the driving sources can be mounted on head 100.

In addition, it is possible not to form inlet 18 in main body 10. In this case, for example, the foaming agent can be injected from discharge hole 114 into space 83*a*. In addition, when inlet 18 is not formed in main body 10, lid 17 can be omitted.

In addition, it is possible to integrally form main body 10 and head 100. That is, it is possible to have a configuration in which head 100 cannot be detached from head mounter 94. At this time, it is possible to have a configuration in which any one of the first transmission mechanism and the second transmission mechanism is omitted.

In addition, it is possible to form thermal surface 36 on a front surface or a rear surface of housing 11.

In addition, it is possible to provide a beauty apparatus without foam generating mechanism 80. In this case, it is possible to remove the dirt on the skin with a beauty apparatus without supplying the foam, or it is possible to remove the dirt on the skin by a beauty apparatus after supplying the foam to the skin by the user himself or another means.

In addition, the specifications (shape, size, layout, and the like) of main body 10, roller portion 110, and other details can be appropriately changed.

Beauty Apparatus Set

In addition, beauty apparatus 1 illustrated in the above exemplary embodiment and the beauty apparatus illustrated in the above modified example can be used as a part of a beauty apparatus set.

Figure 11:
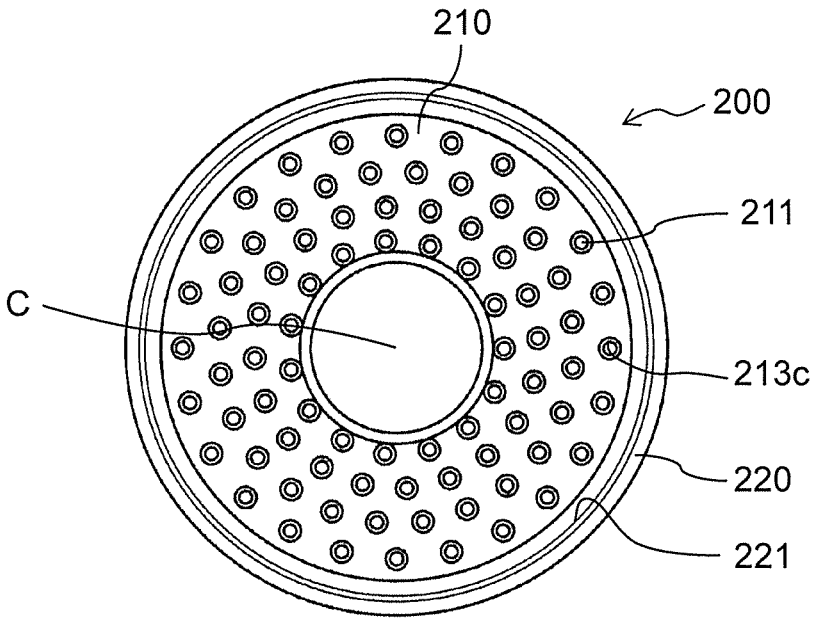
FIG. 11 is a view of another head viewed from the direction of the rotation axis in a case where the beauty apparatus according to the exemplary embodiment is used as a part of a beauty apparatus set.
Figure 12:
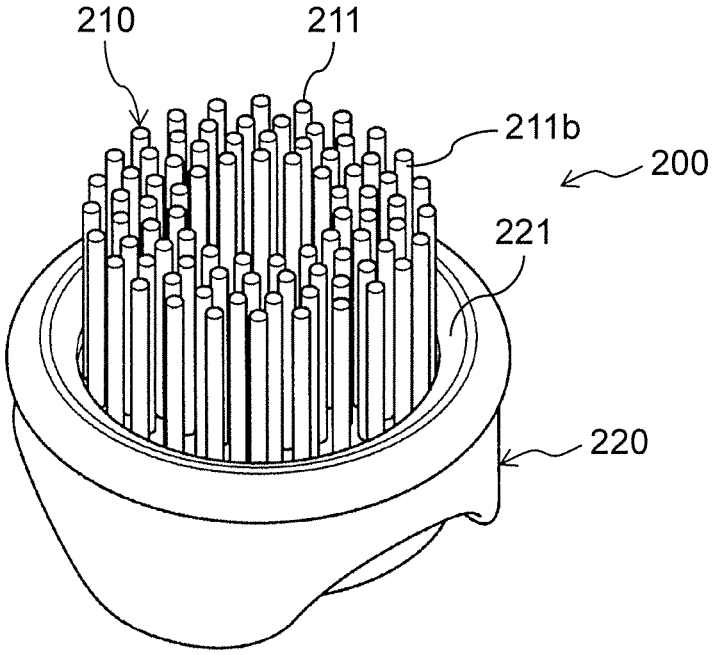
FIG. 12 is a perspective view of another head in a case where the beauty apparatus according to the exemplary embodiment is used as a part of the beauty apparatus set.
Figure 13:
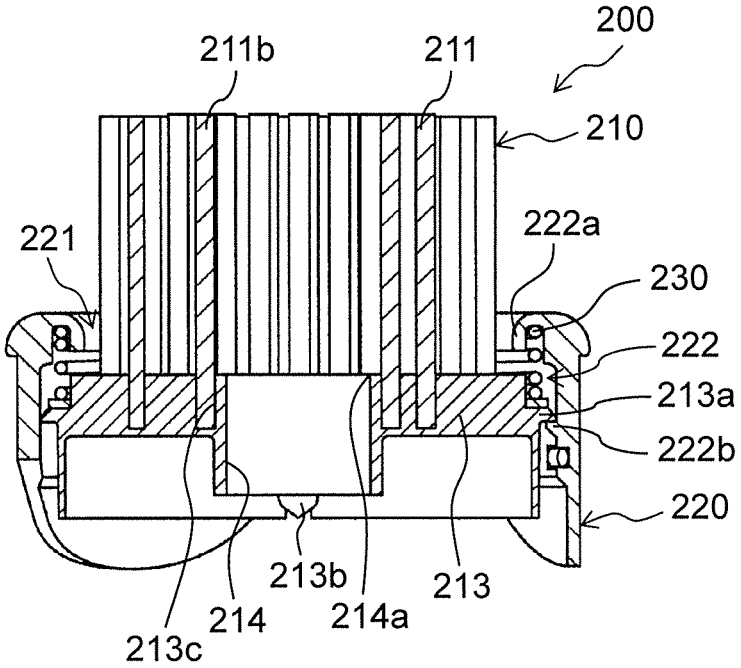
FIG. 13 is a cross-sectional view of another head in a case where the beauty apparatus according to the exemplary embodiment is used as a part of the beauty apparatus set.

For example, it is possible to make a beauty apparatus set including main body 10, head 100, and second head 200 illustrated in FIGS. 11 to 13, and to mount head 100 or second head 200 on the main body 10 according to application so as to be used.

Second head 200 illustrated in FIGS. 11 to 13 scrubs a target portion with brush 211 to which the foam (cleaning liquid) is supplied, thereby promoting removal of the dirt on the target portion (for example, skin of face).

Second head 200 is provided with brush portion 210 and substantially cylindrical head case 220 having opening 221 through which the foam passes formed therein and disposed so as to surround the periphery of brush portion 210.

Brush portion 210 is supported by head case 220 in a state where brush portion 210 can perform operations of rotation and movement with respect to head case 220.

Specifically, as illustrated in FIG. 13, groove 222 is formed on the inner circumferential surface of head case 220. By accommodating fitting portion 213*a* of brush portion 210 in groove 222, brush portion 210 is supported by head case 220 in a state where brush portion 210 can perform operations of rotation and reciprocating movement in the direction of the rotation axis with respect to head case 220.

In addition, a plurality of recesses (not illustrated) to be fitted to the plurality of projections 94*a* of head mounter 94 (refer to FIG. 4) are formed on the inner peripheral surface of head case 220. By fitting the recess (not illustrated) to projection 94*a*, head case 220 is mounted on head mounter 94. Head mounter 94 is non-rotatably fixed to housing 11 (refer to FIG. 3), and head case 220 is non-rotatably mounted on head mounter 94. Therefore, when mounting second head 200 on main body 10, head case 220 is non-rotatably attached to main body 10.

In addition, in groove 222, first regulator 222*a* for regulating brush portion 210 from excessively protruding from head case 220, and a plurality of second regulators 222*b* for regulating brush portion 210 from coming off head case 220 are formed. The plurality of second regulators 222*b* is formed at positions facing first regulator 222*a*. For example, the plurality of second regulators 222*b* can be disposed at equal intervals on the inner peripheral surface of head case 220.

In this manner, first regulator 222*a* and second regulator 222*b* are formed in groove 222, so that brush portion 210 can be supported by head case 220 so as to reciprocate in the direction of the rotation axis within a predetermined range.

Furthermore, second head 200 is provided with elastic member 230 that is disposed between fitting portion 213*a* and first regulator 222*a* and biases brush portion 210 in a direction away from opening 221. As the elastic member 230, for example, a coiled spring can be used. It is possible not to provide elastic member 230.

Brush portion 210 is driven by the driving force of driving source 14 (rotate at least relative to main body 10) when second head 200 is mounted on main body 10, and brush 211 of the same type is provided on basis 213.

In addition, in the center of basis 213, discharge hole (hole) 214 through which the foam passes is formed and brush 211 is formed on the front surface serving as the surface on the side of discharge port 214*a* in basis 213.

In addition, fitting portion 213*a* fitted in groove 222 is formed in the outer periphery of basis 213 and a plurality of hooks 213*b* in contact with the plurality of hooks 93*a* of ring gear 93 are formed on basis 213.

As illustrated in FIG. 11, a plurality of recesses 213*c* are formed on the basis 213 and brush 211 is supported by basis 213 by embedding brush 211 in recess 213*c*.

Brush 211 is preferably formed using a soft material. Therefore, bristle 211*b* formed by bundling a plurality of bristles is formed in second head 200, and bristle 211*b* is embedded in recess 213*c* formed in basis 213 to form brush 211.

When second head 200 having such a configuration is mounted on main body 10, a recess (not illustrated) formed on the inner peripheral surface of head case 220 is fitted to projection 94*a* of head mounter 94, and head case 220 is mounted on head mounter 94. Hook 213*b* formed on basis 213 comes into contact with hook 93*a* formed on ring gear 93, and the torque is transmitted to brush portion 210 by ring gear 93.

At this time, discharge hole (hole) 214 formed at the center of brush portion 210 communicates with space 83*a* of container 83 via the space inside cam gear 91 and the like.

Therefore, when driving source 14 is driven with second head 200 mounted on main body 10, brush portion 210 rotates relative to head case 220 (main body 10), and the foam generated by foam generating mechanism 80 are discharged from discharge hole 214.

Second head 200 can be configured to move in the direction of the rotation axis (vertical direction in FIG. 4) while rotating brush portion 210 about rotation center C in a state of being mounted on main body 10.

The head portion provided in the beauty apparatus set is not limited to second head portion 200, and may be provided with another head instead of second head 200, or may be provided with another head in addition to second head 200.

As another head, for example, there is a head in which a stirring mechanism for stirring the foam is supported by a head case.

The beauty apparatus according to the disclosure is provided with the main body having the gripper and the head attached to one end of the main body. Furthermore, a substantially circular opening for discharging the foam is provided in the head, and substantially spherical rollers are provided on at least one shaft extending in the circumferential direction of the opening.

With this configuration, since a roller rotating on the skin surface stirs the foam and cleanses the face while massaging the face, it is possible to achieve both the appropriate facial cleansing effect and the massage effect.

In addition, in the beauty apparatus according to the disclosure, the driving source may be incorporated in the main body, and the roller may be rotated about the opening by rotational driving of the driving source.

With this configuration, since the foam can be stirred on the skin surface, it is possible to provide the beauty apparatus which is safer against the skin.

In addition, in the beauty apparatus according to the disclosure, the roller may be spring-biased substantially at right angles to the direction of rotation.

With this configuration, since the roller can be applied along the shape of the skin, the skin contact can be improved.

In addition, in the beauty apparatus according to the disclosure, the roller may rotate freely with respect to the shaft.

With this configuration, since the roller can be rotated along the shape of the skin, the skin contact can be improved.

In addition, in the beauty apparatus according to the disclosure, the head may have a structure in which a roller portion holding the roller is accommodated in a cylindrical head case having an opening.

With this configuration, since the foam is retained inside the head case, the foam can easily be brought close to the skin.

In addition, in the beauty apparatus according to the disclosure, a part of the roller protrudes from the head case in a side view, and when the skin is pressed against the protruding portion, the entire roller may be accommodated in the head case.

With this configuration, since the roller can be applied while the foam is brought close to the skin, it is possible to further enhance the facial cleansing effect.

In addition, in the beauty apparatus according to the disclosure, even in a state where the roller protrudes mostly from the head case, the shaft may be accommodated in the head case.

With this configuration, approximately half of the roller can protrude, and it is possible to appropriately obtain both the feeling of washing with the foam and the feeling of massage.

In addition, in the beauty apparatus according to the disclosure, the through-hole may be formed on the outer edge of the bottom surface of the roller portion.

With this configuration, since the heavy foam containing water can be dropped from the through-hole by centrifugal force, it is possible to hold the dense foam in the head case.

In addition, in the beauty apparatus according to the disclosure, the opening may be disposed at a position facing the skin at the time of use.

With this configuration, since the opening can be easily applied to the skin, it is possible to provide the beauty apparatus that is easy to use.

As described above, since the beauty apparatus according to the disclosure can wash the face with the foam while massaging the skin, the beauty apparatus can be applied to applications in the medical field and the like.

What is claimed is:

1. A beauty apparatus comprising:

a main body having a gripper;

a head attached to one end of the main body;

a central ring; and a foam generating mechanism, wherein a circular opening from which foam generated by the foam generating mechanism is discharged is provided in the head, the central ring is disposed on the head within the circular opening, wherein a spherical roller extends outward from the central ring, the spherical roller is provided on at least one shaft extending in a circumferential direction of the circular opening, and the foam generating mechanism comprises:

a first rotor and a second rotor; and a container having a space for storing a foaming agent and water.

2. The beauty apparatus of claim 1, wherein a driving source is incorporated in the main body, and the spherical roller is rotated about a rotation center of the circular opening by a rotational driving of the driving source.

3. The beauty apparatus of claim 2, wherein the spherical roller is spring-biased at right angles to a direction of rotation.

4. The beauty apparatus of claim 2, wherein the spherical roller rotates freely with respect to the at least one shaft.

5. The beauty apparatus of claim 3, wherein the spherical roller rotates freely with respect to the at least one shaft.

6. The beauty apparatus of claim 1, wherein the head has a rotating structure holding the spherical roller and the rotating structure is accommodated in a cylindrical head case having the circular opening.

7. The beauty apparatus of claim 6, wherein a part of the spherical roller protrudes from the cylindrical head case in a side view, and when a skin of a user is pressed against a protruded portion, an entirety of the spherical roller is accommodated in the cylindrical head case.

8. The beauty apparatus of claim 7, wherein when in a state where the spherical roller protrudes half from the cylindrical head case, the at least one shaft is accommodated in the cylindrical head case.

9. The beauty apparatus of claim 6, wherein a through-hole is formed on an outer edge of a bottom surface of the spherical roller portion.

10. The beauty apparatus of claim 1, wherein the circular opening is disposed at a position facing a skin of a user at a time of use.

11. The beauty apparatus of claim 1, further comprising a thermal mechanism for generating heat to warm a skin of a user.

12. The beauty apparatus of claim 7, wherein the cylindrical head case has an upper surface and an amount of protrusion of the spherical roller from the upper surface of the cylindrical head case is 2-4 mm.

13. The beauty apparatus of claim 7, wherein the cylindrical head case has an upper surface and an amount of protrusion of the spherical roller from the upper surface of the cylindrical head case is 3 mm.

14. The beauty apparatus of claim 1, wherein the first rotor and the second rotor generate the foam by stirring a foaming agent, water, and air, and the first rotor and the second rotor are configured to rotate in opposite directions with each other.

* * * * *